United States Patent [19]

Roznieckí

[11] Patent Number: 4,524,911

[45] Date of Patent: Jun. 25, 1985

[54] OSCILLATING FLOW NOZZLE

[76] Inventor: Edward J. Roznieckí, 31041 Angeline, St. Clair Shores, Mich. 48082

[21] Appl. No.: 581,521

[22] Filed: Feb. 21, 1984

[51] Int. Cl.[3] ..... B05B 1/08

[52] U.S. Cl. ..... 239/101; 239/446; 239/DIG. 7

[58] Field of Search ..... 239/101, 99, 446, 102, 239/DIG. 7

[56] References Cited

U.S. PATENT DOCUMENTS

| | | | |
|---|---|---|---|
| 3,784,103 | 1/1974 | Cooley | 239/101 |
| 4,275,842 | 6/1981 | Purton et al. | 239/446 |
| 4,484,710 | 11/1984 | Roznieckí | 239/DIG. 7 X |

*Primary Examiner*—Andres Kashnikow

*Assistant Examiner*—Daniel R. Edelbrock

*Attorney, Agent, or Firm*—Peter A. Taucher; John E. McRae; Robert P. Gibson

[57] ABSTRACT

A liquid spray nozzle especially designed to spray vaporizable liquid fire extinguishant onto an explosive fireball. A minor portion of the incoming liquid is used to develop transversely directed liquid pulses which act on the liquid mainstream to deflect the stream from one nozzle boundary wall to another boundary wall. The exit stream from the nozzle exhibits a transversely oscillating character for minimizing vacant spots in the spray pattern while achieving a relatively divergent spray cross section. The method of oscillating the mainstream uses a relatively small energy expenditure so that the mainstream has a relatively long spray penetration distance.

16 Claims, 7 Drawing Figures

OSCILLATING FLOW NOZZLE

GOVERNMENT INTEREST

The invention described herein may be manufactured, used, and licensed by or for the Government for governmental purposes without payment to me of any royalty thereon.

BACKGROUND AND SUMMARY OF THE INVENTION

This invention relates to a liquid spray nozzle especially useful in fire suppressant systems for spraying Halon 1301 or similar vaporizable liquid fire extinguishant. Such systems commonly include one or more thick-walled bottles containing liquid fire extinguishant (Halon 1301) and a pressurizing agent, such as nitrogen gas. During standby periods the pressurized liquid fire extinguishant is retained within the bottle by means of a frangible metal diaphram. An annular cutter knife is arranged to pierce the frangible diaphram under the action of an explosive squib, thereby releasing the liquid fire extinguishant for flow from the bottle through a suitable nozzle to the flame area.

The present invention is directed to a special nozzle structure for use in the above referenced fire suppression system. The nozzle structure can be used in other systems, e.g., fire suppressant systems using overhead sprinklers, or shower heads used for bathing purposes. Areas in which the nozzle structure could be used include military vehicles, computer rooms, aircraft cabin areas, commercial buildings, bathrooms, etc.

A principle aim of the invention is to provide a nozzle having a divergent outlet chamber or passage, together with mechanism for generating transversely-acting liquid control pulses, such that the outgoing spray oscillates back and forth across the plane of the nozzle outlet opening. The oscillation is preferably very rapid, e.g., 100 oscillations/sec. to minimize vacant spots in the spray pattern.

Another object of the invention is to provide an oscillation-type nozzle wherein the outlet spray pattern is relatively even or uniform across the spray pattern cross-section.

Another object of the invention is to provide an oscillation-type nozzle that requires only a relatively small energy expenditure to achieve the oscillating action, thereby achieving a relatively long spray penetration distance.

A further object is to provide a nozzle wherein the spray pattern has a divergent character, e.g., conical or fan-shaped.

A related object is to provide nozzle wherein the divergent spray pattern can have a relatively large included angle, e.g., eighty degrees.

Another object of the invention is to provide a nozzle that is self contained, i.e., without external controls or triggering mechanisms.

IN THE DRAWINGS

Figure 1:
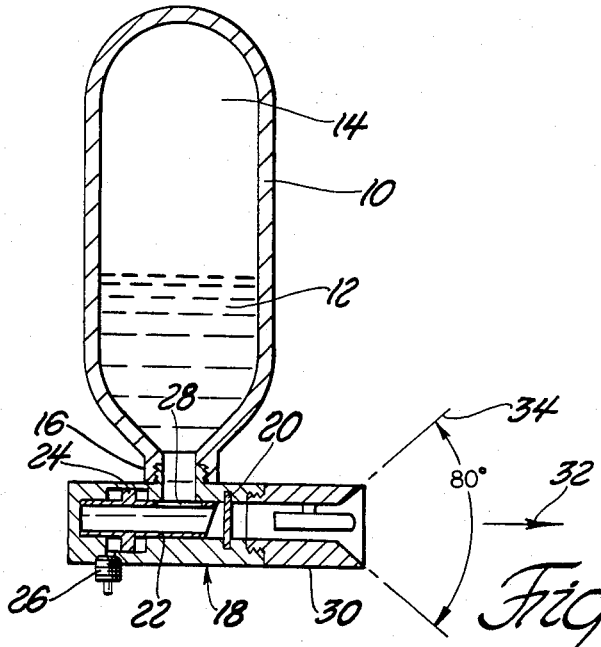
FIG. 1 shows a fire suppressant bottle-nozzle assembly utilizing the present invention.

Referring in greater detail to FIG. 1, there is shown a fire suppressant mechanism that comprises an upright bottle 10 formed of pressure-resistant material to contain a liquid fire extinguishant 12, e.g., Halon 1301 ($CF_3Br$) The upper portion of the bottle is occupied by an inert pressurizing gas 14 such as nitrogen and minute quantities of extinguishant vapor at a total pressure in the neighborhood of 750 psi.

The bottle outlet 16 connects with a valve nozzle assembly designated generally by numeral 18. The valve in this case is a frangible metal disk 20 adapted to be pierced by an annular knife 22. An annular piston 24 is carried by knife 22 for moving the knife rapidly to the right when explosive squib 26 is energized. An opening 28 in knife 22 enables the pressurized liquid 12 to flow out of the bottle and through the nozzle 30 in the general direction designated by numeral 32. Commonly the time required to empty the bottle of liquid fire suppressant is about 100 milliseconds.

The present invention is concerned with structuring or designing nozzle 30 so that the spray of liquid discharged by the nozzle has a divergent nature as designated by numeral 34 in FIG. 1. The preferred spray pattern is an oscillating pattern wherein the liquid jet continually is redirected between a "straight ahead" path along the nozzle axis and a "divergent" path representing the outer boundary limit of the stream. Preferably the oscillation rate is relatively high, e.g., 100 oscillations/sec. During the time required for the bottle to completely empty there would be about 10 transverse oscillations of the liquid while it is being sprayed out of nozzle 30.

Figure 2:
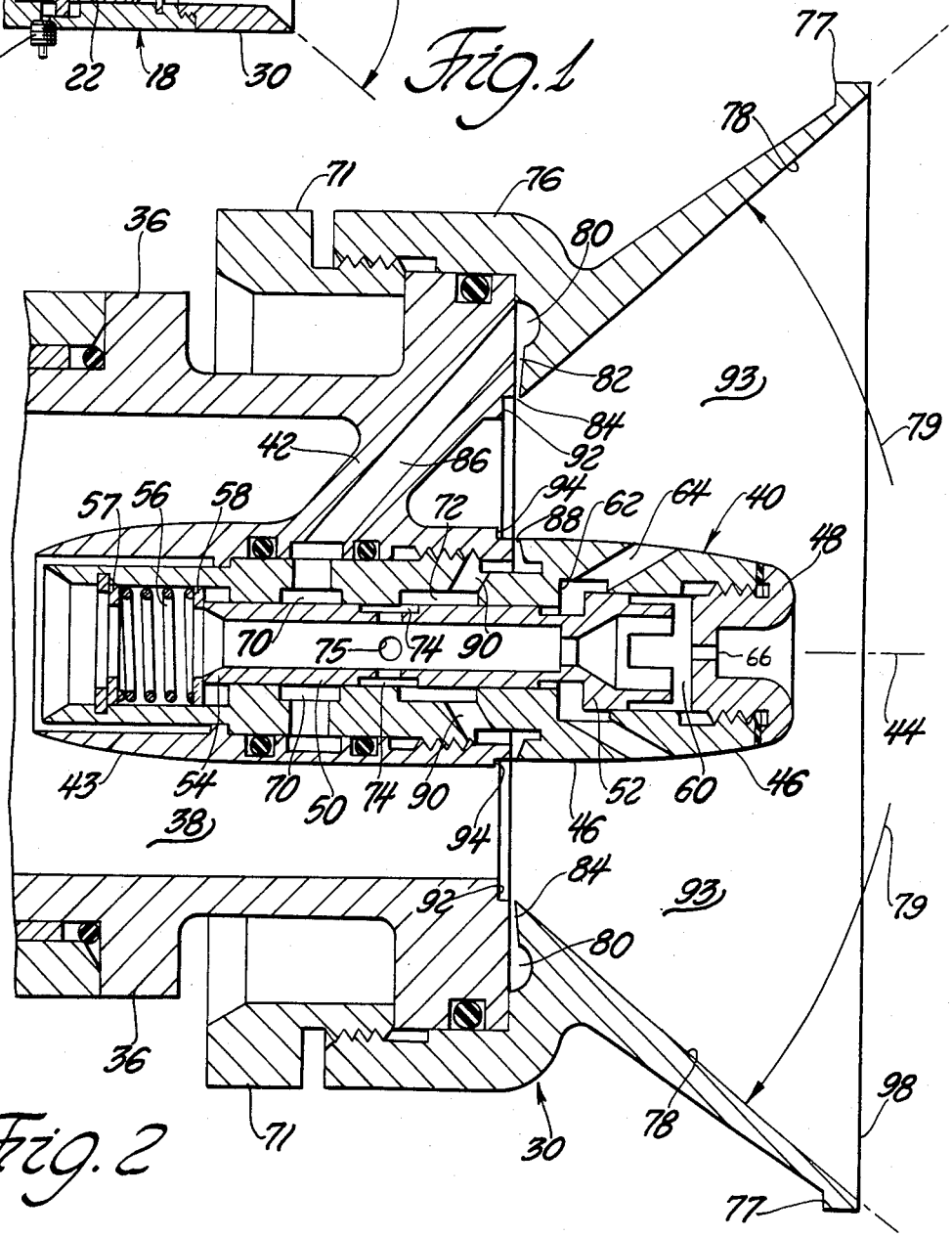
FIG. 2 is an enlarged sectional view taken through the nozzle used in the FIG. 1 assembly.

FIG. 2 illustrates nozzle 30 in somewhat greater detail. The nozzle structure there shown includes an annular duct 36 defining a liquid inlet passage 38. Arranged within the nozzle is an elongated hollow housing 40 supported from duct 36 by means of two or more struts or ribs 42; preferably three equi-distantly spaced struts are used. Housing 40 is centered on the duct 36 flow axis defined by imaginary centerline 44.

Housing 40 may be constructed in various ways, using differently configured sub-assemblies. As shown, the housing includes a main housing element 43 rigidly attached to struts 42, and a second housing element 46 screwed into element 43. The housing is completed by a nose cap 48 threaded into the downstream end of housing element 46.

Floatably positioned within housing 40 is a hollow piston 50 having a relatively large diameter section 52 at its downstream end and a relatively small diameter section 54 at its upstream end. A compression coil spring 56 is trained between a ring 57 suitably mounted on housing 40 and an annular disk 58 abuting against the upstream end of piston 50. Spring 56 urges the piston in a rightward direction.

Some of the liquid flowing rightwardly along inlet passage 38 enters the open end of housing 40 and flows through the central passage in piston 50 to a chamber 60. Chamber 60 will sometimes be referred to as a flow-interruption chamber, because it interrupts the flow out of housing 40 (except that some liquid flows out through orifice 66). During service liquid builds up in chamber 60 to exert a leftward reaction force on piston section 52, thereby moving the piston leftwardly against the force of spring 56. As piston section 52 reaches the housing shoulder surface 62 piston section 52 uncovers vent ports 64, which communicate with the piston side surface. This action enables the pressurized liquid in chamber 60 to be vented through ports 64, thus momentarily lowering the pressure in chamber 60. Spring 56 is thereby enabled to move the piston 50 rightwardly toward its illustrated position. Rightward piston motion is limited by cap 48.

The oscillation rate of piston 50 may be varied by controlling the rate of pressure rise in chamber 60. Such pressure rise is related to the size of a small regulator port or orifice 66 in cap 48. The smaller the size of port 66 the more abrupt will be the pressure rise in chamber 60. The rate of pressure collapse in chamber 60 is controlled largely by the spacing between shoulder surface 62 and the left face of piston section 52, i.e., the port area 64 exposed to chamber 60 when the piston is in its leftmost position.

The inner annular surface of housing 40 is machined to form two annular cavities 70 and 72 at spaced points along the housing surface. Piston 50 is machined to have a pressure pulse distribution cavity or port 74 in its outer surface; four holes 75 are drilled through the piston wall to conduct pressurized liquid from the piston interior space to cavity 74.

As piston 50 reciprocates back and forth within housing 40 its pulse distribution cavity 74 alternately communicates with housing cavity 70 and housing cavity 72; FIG. 2 shows cavity 74 communicating with cavity 72. Leftward motion of the piston causes cavity 74 to communicate with housing cavity 70.

The nozzle assembly includes an annular housing component 76 suitably attached to aforementioned duct 36, as by means of a clamping nut 71. Inner annular surface 78 of housing component 76 diverges away from flow axis 44 in the downstream direction. In the illustrated structure the included cone angle 79 defined by surface 78 is about eighty degrees. The actual cone angle in any particular situation depends on particular spray requirements. A bathroom shower head would generally require a smaller cone angle. An overhead sprinkler installation might require a relatively large cone angle, depending on the area to be protected. A confined space within a military vehicle might dictate an intermediate value spray cone angle.

Housing component 76 is provided with a circumferential groove 80 and associated angulated surface 82. Groove 80 and surface 82 cooperate with the right end face of duct member 36 to define an annular flow deflector orifice 84. The aforementioned housing cavity 70 supplies pressurized liquid pulses to orifice 84 via a control passage system 86 extending through the various struts 42.

A second annular flow deflector orifice 88 is formed in the outer surface of housing 40. In the illustrated structure this second flow deflector orifice is an annular slot formed by the operation of threading member 46 into member 43. Orifice 88 communicates with aforementioned cavity 72 via a control passage system 90 (i.e., a system of machined holes).

During service liquid flows through inlet passage 38 into outlet chamber 93 defined by divergent frusto-conical surface 78. The outer boundary surface of the flowing liquid stream passes over a step 92 at the juncture between inlet member 36 and outlet member 76. A low pressure zone is created at the step, such that the liquid tends to attach itself to divergent surface areas 78. The liquid can be made to detach itself from surfaces 78 by the presence of a liquid control pulse discharging out of annular orifice 84.

The outer surface of housing 40 has an annular step 94 in approximately the same plane as above-mentioned step 92. Liquid flowing along the surface of housing 40 tends to attach itself to the housing surface by reason of the low pressure condition associated with step 94. The action is generally known as the Coanda effect. Liquid attached to the surface of housing 40 can be made to detach itself from the housing surface by means of a liquid control pulse discharged from flow deflector orifice 88.

The oscillating piston 50 constitutes a pulse generation means for supplying pressure pulses alternately to flow deflector orifices 84 and 88. The pulses are delivered sequentially (alternately), whereby orifice 84 is inactive when orifice 88 is pressurized, and vice versa. When orifice 84 is discharging a control pulse the main liquid stream detaches itself from surface 78 and attaches itself onto the surface of housing 40. When orifice 88 is discharging a control jet the main liquid is attached onto surface 78.

The attachment-detachment actions are preferably very rapid, e.g., 100 actions per second. Due to the rapidity of the action successive liquid increments will take different directions as they pass across the plane of the outlet opening 98. The attachment-detachment forces will affect successive flow increments to varying degrees such that a range of flow directions will be produced, within the cone angle limit 79. Hopefully a fairly even flow distribution along outlet plane 98 will be realized. It is believed that some control on the evenness of flow distribution can be achieved by optimizing the size of regulator opening 66 (in cap 48) and the design spacing between shoulder 62 and the left face of piston section 52. Opening 66 tends to control the rate of piston motion in the leftward direction; the location of shoulder 62 tends to control the resistance offered by the piston to rightward motion.

The FIG. 2 nozzle produces a generally conical flow pattern having a relatively even solid character along the nozzle cross-section. Outflow through central orifice 66 is relatively constant. Flow through the space between housing 40 and nozzle surface 78 is oscillatory in nature.

The FIG. 2 nozzle structure has a number of relatively small size orifices and port openings therein. To prevent ambient atmospheric dirt or contaminants from movement into the nozzle for potential clog up of the small openings a thin plastic or elatomeric dust shield (not shown) may be positioned over the nozzle outlet opening 98. The dust shield would comprise a thin disk having a peripheral flange adapted to snap over retainer lip 77 on nozzle outlet member 76. When pressurized extinguishant is flowing through the nozzle the dust shield is bursted or blown off the nozzle structure.

When the nozzle structure is used in a military vehicle to discharge pressurized fire extinguishant it may not always be possible to position the bottle-nozzle assembly (FIG. 1) in a completely unobstructed location. The bottle-nozzle assembly is usually positioned on or near one of the vehicle walls, with the nozzle oriented to spray pressurized extinguishant toward the vehicle interior space. Equipment within the nozzle spray path (between the nozzle and target area) can partially obstruct or disrupt the spray, thereby lessening the total fire suppressant action. In such cases it is desirable that the nozzle be constructed so that extinguishant flow takes place only through non-obstructed nozzle areas. The aim is to minimize the quantity of non-effective fire extinguishant, and to maximize the quantity of fire extinguishant reaching the fireball.

Figure 5:
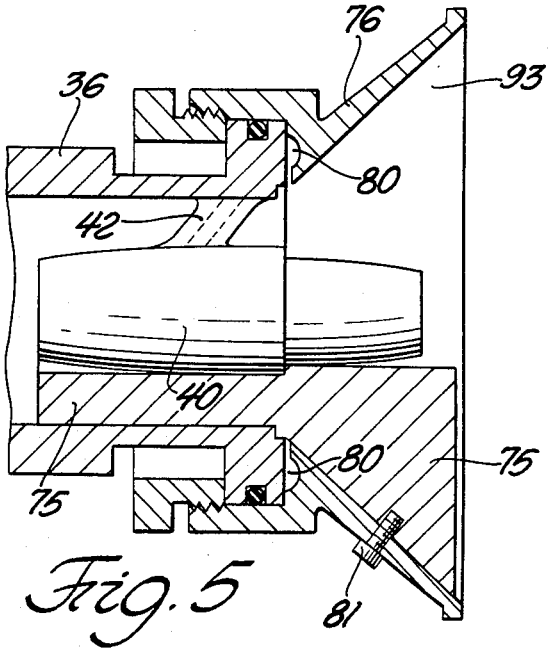
FIG. 5 is a view of the FIG. 2 nozzle on a reduced scale, but with the addition of a filler member therein.
Figure 6:
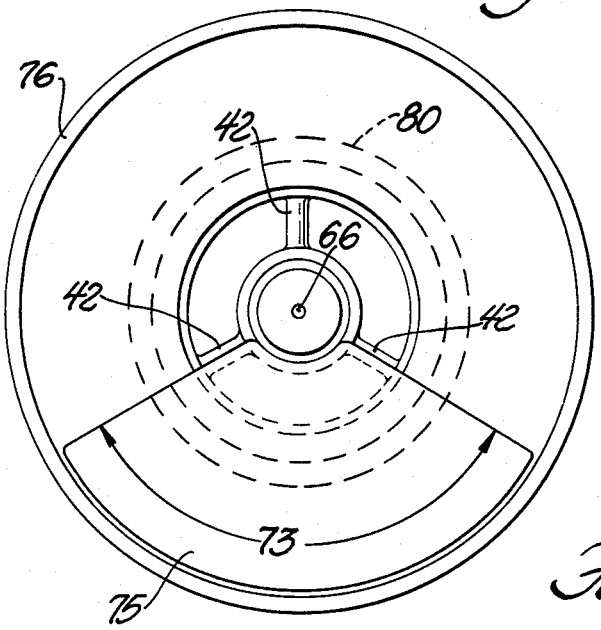
FIG. 6 is a right end view of the FIG. 5 nozzle assembly.

FIGS. 5 and 6 illustrate the FIG. 2 nozzle structure (on a reduced scale), with an add-on filler member 75 installed in the nozzle outlet to prevent flow of fire extinguishant through the portion of nozzle chamber 93 designated by numeral 73. One or more screws 81 may be used to lock filler member 75 in the nozzle structure.

Filler member 75 would be configured to conform to the contours on housing 40 and members 36 and 76, thereby preventing liquid flow through the space designated by numeral 73. By thus preventing flow through the lower portion of the nozzle (between the four o'clock and eight o'clock positions) the flow through the upper portions of the nozzle will be increased, thereby increasing the effectiveness of the extinguishant on contacted areas. The location of filler member 75 in the nozzle is dictated by the location of exterior obstructions.

Use of filler member 75 with a pre-existing nozzle structure is advantageous chiefly in minimizing the number of differently configured nozzle components that must be constructed. It would be possible to construct nozzles with filler members as permanent parts of the nozzle walls; however it is believed that overall manufacturing costs would be increased.

Figure 3:
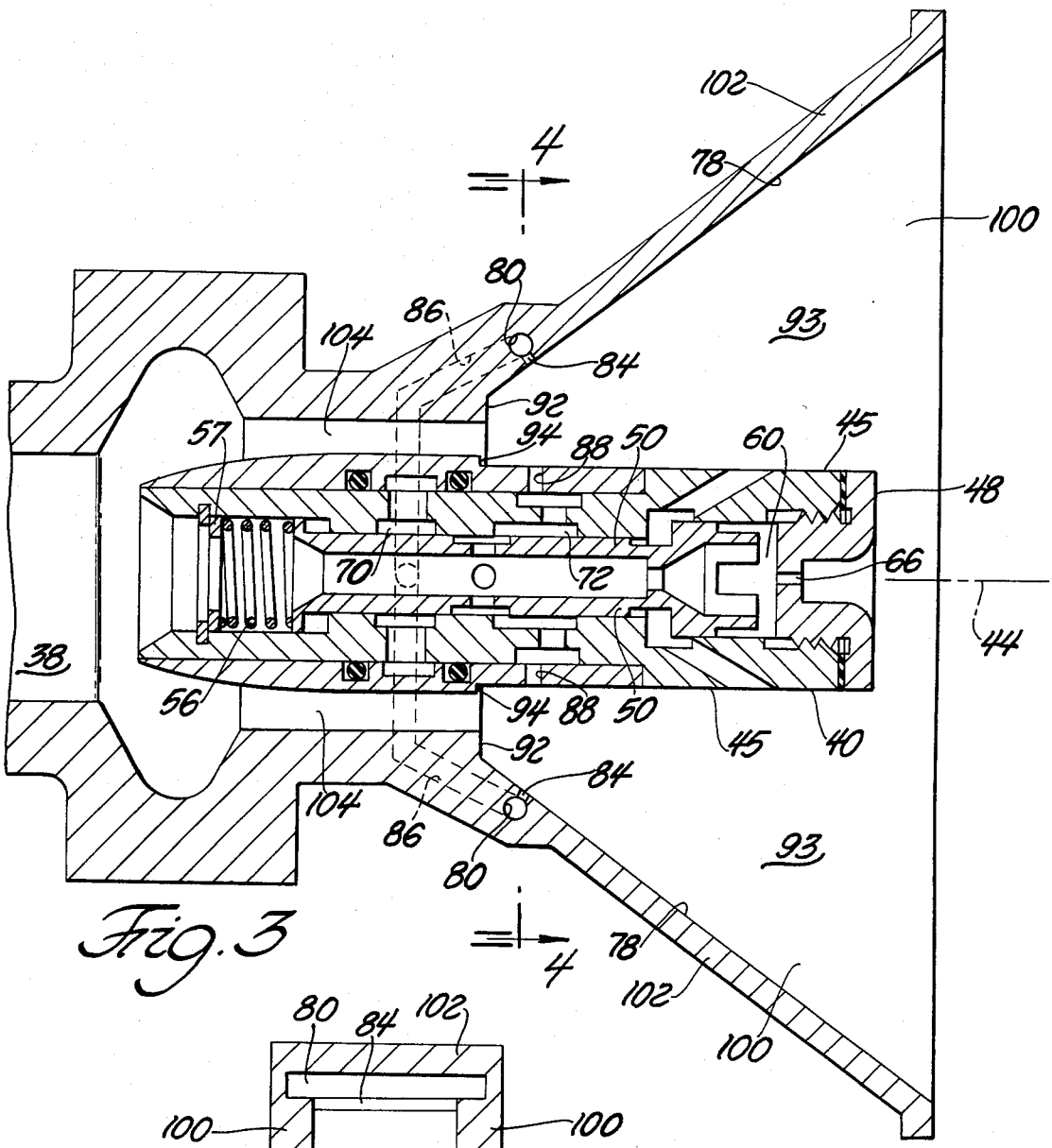
FIG. 3 is a view similar to FIG. 2 but illustrating an alternate form of nozzle embodying my invention.
Figure 4:
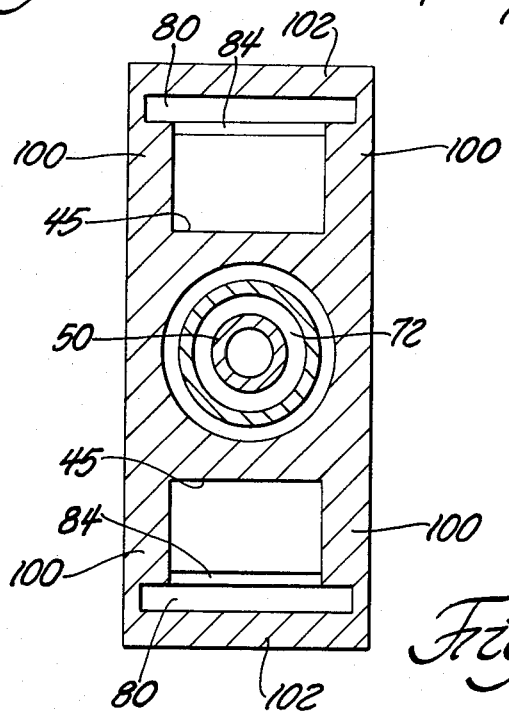
FIG. 4 is a sectional view taken on line 4—4 in FIG. 3.

The FIG. 2 nozzle (without filler member 75) produces a generally conical flow pattern wherein the flow oscillates toward and away from flow axis 44. FIGS. 3 and 4 illustrate an alternate form of the invention wherein the oscillating flow occupies a single plane (i.e., within the plane of the paper in FIG. 3). In this case the nozzle comprises two flat parallel walls 100 interconnected by two divergent walls 102. Housing 40 extends in the space between walls 100 along flow axis 44. Faces 45 of the housing are flat; in like fashion surfaces 78 of divergent walls 102 are flat.

Liquid flows from inlet chamber 38 through two flat rectangular slot-like passages 104 and thence into outlet chamber 93. Divergent walls 102 are equipped with slot-like deflector orifices 84. Housing 40 is equipped with slot-like deflector orifices 88. Flat steps 92 and 94 are formed at the junctures between passages 104 and nozzle outlet chamber 93.

Housing 40 has mounted therewithin a floating piston 50 that serves the same function as the corresponding piston in the FIG. 2 arrangement, i.e., a pulse generating function. A control passage system 86 delivers control pulses to orifices 84. A second control passage system delivers control pulses to orifices 88. The nozzle output is an oscillating stream alternately attachable to nozzle surfaces 78 and housing surfaces 45. The action is similar to that described in connection with FIG. 2, except that the fan-shaped pattern is flat (planar) rather than conical.

Figure 7:
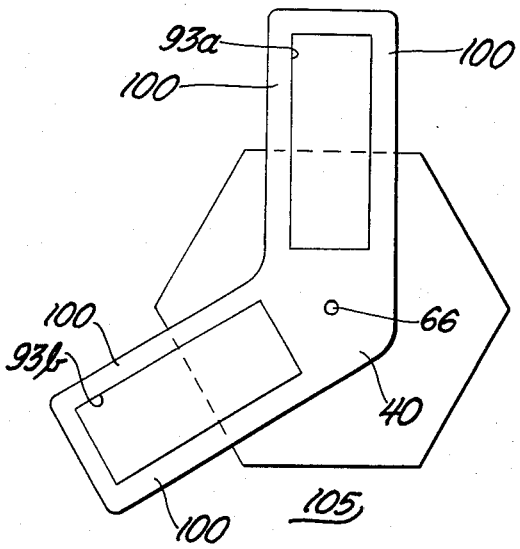
FIG. 7 is an end view of a variant of the FIG. 3 nozzle.

FIG. 7 is an end elevational view of a nozzle constructed generally similarly to the FIG. 3 nozzle, except that the lower portion of the nozzle body is angled in a right-to-left direction (when looking toward the nozzle outlet opening). The resultant spray pattern is two oscillating spray sections having cross sections corresponding in shape and orientation to outlet chambers 93*a* and 93*b*.

The FIG. 7 construction would be used in situations where the area in line with space 105 is partially obstructed. By angling the lower portion of the nozzle outlet body in a right-to-left direction the lower spray component discharged from chamber 93*b* can be made to bypass the obstruction. If the entire area below the flow orifice 66 were obstructed then the nozzle structure could be modified to eliminate chamber 93*b*; in that event the flow would be confined to the oscillatory flow out of chamber 93*a* and the small jet of liquid out of orifice 66.

With the various illustrated forms of the invention it is presumed that control orifices 84 and 88 will produce at least partial detachment of the liquid stream from the associated wall surfaces. However, there may not be a pronounced switching of the entire stream from one surface to the other. Instead the stream may be distributed across nozzle outlet chamber, with more liquid in the zone away from the pressurized orifice and less liquid in the zone near the pressurized orifice. By oscillating the flow of control liquid to the different orifices it should be possible to rapidly shift the areas of maximum flow back and forth, to thereby maintain a fairly uniform average flow rate across the width of the outlet spray pattern.

An advantage of the described arrangements is the fact that no deflectors or baffles are used to redirect or obstruct the liquid stream. Such deflectors interfere with the momentum of the liquid particles and thereby reduce the range distance of the discharged stream. A long range (penetration) distance is particularly desirable for nozzles used in certain fire suppressant systems. The present invention controls the spray direction without using baffles or deflectors.

I wish it to be understood that I do not desire to be limited to the exact details of construction shown and described for obvious modifications will occur to a person skilled in the art, without departing from the spirit and scope of the appended claims.

I claim:

1. A liquid spray nozzle comprising a liquid inlet passage means defining a flow axis; a liquid outlet passage means connected to the inlet passage means; said outlet passage means defining first liquid attachment surfaces diverging away from the flow axis in the downstream direction; an elongated hollow housing within the nozzle centered on the flow axis; said hollow housing defining second liquid attachment surfaces extending generally parallel to the flow axis; first flow deflector orifice means in the first liquid attachment surfaces; second flow deflector orifice means in the second liquid attachment surfaces; liquid pulse generation means within the hollow housing; a first control passage system between the pulse generation means and said first orifice means; and a second control passage system between the pulse generation means and the second orifice means, whereby the main liquid flow is deflected from the first attachment surfaces to the second attachment surfaces while the pulse generation means is delivering a control pulse to the first orifice means, and the main liquid flow is deflected from the second attachment surfaces to the first attachment surfaces while the pulse generation means is delivering a control pulse to the second orifice means.

2. The liquid spray nozzle of claim 1: said pressure pulse generation means comprising a hollow piston having its opposite ends exposed to inlet chamber pressure; the downstream end of the housing forming a flow-interruption chamber for generating a pressure against the downstream end of the piston to move same in one direction; and spring means trained between the housing and the piston to move same in the opposite direction, whereby the piston is caused to rapidly reciprocate back and forth within the housing.

3. The liquid spray nozzle of claim 2: said housing having a vent port communicating with a side of the piston whereby motion of the piston in said one direction causes pressures within the flow-interruption chamber to be vented through the vent port.

4. The liquid spray nozzle of claim 2: said spring means being a compression coil spring located at the end of the piston remote from the flow-interruption chamber.

5. The liquid spray nozzle of claim 2: said housing having first and second annular cavities located at spaced points along the housing length in facing relation to the housing side surface; said piston having a pulse distribution port in its side surface; said pulse distribution port being movable into registry with alternate ones of the housing cavities responsive to reciprocating movement of the hollow piston.

6. The liquid spray nozzle of claim 5: said first cavity being connected to the aforementioned first control passage system; said second cavity being connected to the aforementioned second control passage system.

7. The liquid spray nozzle of claim 2: said housing having a continuously open regulator port communicating with the flow-interruption chamber to limit the rate of pressure rise in said chamber.

8. The liquid spray nozzle of claim 1: said housing being oriented so that its downstream end is in a plane slightly upstream from the plane of the nozzle outlet opening defined by the outlet passage means.

9. The liquid spray nozzle of claim 1, and further comprising support strut means between the inlet passage means and the hollow housing; the aforementioned first control passage system comprising passages extending within the strut means to deliver liquid pulses to the first flow deflector orifice means.

10. The liquid spray nozzle of claim 1 and further comprising first step means at the juncture between the inlet passage means and outlet passage means to facilitate liquid attachment to the passage means surface, second step means on the outer surface of the hollow housing to facilitate liquid attachment to the housing surface; said first and second step means being upstream from the first and second flow deflector orifice means.

11. The liquid spray nozzle of claim 1 wherein the outlet passage means is configured to define frusto-conical liquid attachment surfaces.

12. The liquid spray nozzle of claim 11 wherein the included angle of the frusto-conical liquid attachment surfaces is approximately eighty degrees.

13. The liquid spray nozzle of claim 1 wherein the outlet passage means is configured to define two flat liquid attachment surfaces diverging from the aforementioned flow axis at equal angles; the housing having two flat liquid attachment surfaces in the same general plane as the divergent surfaces, whereby the discharging liquid oscillates between the facing flat surfaces.

14. The liquid spray nozzle of claim 13 wherein the included angle of the divergent surfaces is approximately eighty degrees.

15. The liquid spray nozzle of claim 1, wherein the passage means is structured to handle vaporizable liquid fire extinguishant at pressures in the neighborhood of 750 p.s.i.

16. The liquid spray nozzle of claim 1 wherein the pulse generation means has a pulse generaton frequency of approximately 100 pulses per second.

* * * * *